US011136872B2

(12) United States Patent
Roesner et al.

(10) Patent No.: US 11,136,872 B2
(45) Date of Patent: Oct. 5, 2021

(54) APPARATUS AND METHOD OF DISBURSING MATERIALS INTO A WELLBORE

(71) Applicant: Cameron International Corporation, Houston, TX (US)

(72) Inventors: Thomas G. Roesner, Cypress, TX (US); Bruce A. Hogg, Houston, TX (US); Craig L. Cotton, Cypress, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 15/834,866

(22) Filed: Dec. 7, 2017

(65) Prior Publication Data

US 2018/0171770 A1 Jun. 21, 2018

Related U.S. Application Data

(60) Provisional application No. 62/432,301, filed on Dec. 9, 2016.

(51) Int. Cl.

| | |
|---|---|
| ***E21B 43/267*** | (2006.01) |
| ***E21B 33/068*** | (2006.01) |
| ***E21B 21/06*** | (2006.01) |

(52) U.S. Cl.

CPC ..... *E21B 43/267* (2013.01); *E21B 21/062* (2013.01); *E21B 33/068* (2013.01)

(58) Field of Classification Search

CPC ..... E21B 43/267; E21B 21/062; E21B 33/068
See application file for complete search history.

(56) References Cited

U.S. PATENT DOCUMENTS 2,478,079 A * 8/1949 Beasley ..... B01F 15/0235 222/136
2,755,863 A * 7/1956 Webber ..... E21B 33/068 166/310

(Continued)

FOREIGN PATENT DOCUMENTS

| | | |
|---|---|---|
| WO | 2007098606 A1 | 9/2007 |
| WO | 2012037676 A1 | 3/2012 |
| WO | 2015088827 A1 | 6/2015 |

OTHER PUBLICATIONS

PCT International Search Report & Written Opinion for PCT Application No. PCT/US2017/065470 dated May 25, 2018; 19 Pages.

(Continued)

*Primary Examiner* — Aaron L Lembo

(57) ABSTRACT

A system includes a dispensing device having a material chamber to store an oilfield material and to fluidly couple to a wellhead, a plurality of flow control devices to control a flow of the oilfield material via the material chamber, a plurality of sensors to measure one or more properties related to the dispensing device, and a control system communicatively coupled to the dispensing device. The control system opens a first flow control device to fill the material chamber with the oilfield material, monitors a condition associated with the material chamber based on the properties measured via the plurality of sensors, opens a second flow control device to provide a high pressure fluid into the material chamber when the condition is present, and open a third flow control device, where the third flow control device fluidly couples the material chamber to the wellhead.

5 Claims, 14 Drawing Sheets

(56) References Cited

U.S. PATENT DOCUMENTS

| | | | | |
|---|---|---|---|---|
| 3,560,053 | A | 2/1971 | Ortloff | |
| 4,183,813 | A | 1/1980 | Black et al. | |
| 6,269,875 | B1 | 8/2001 | Harrison, III et al. | |
| 6,283,202 | B1 | 9/2001 | Gaines | |
| 7,571,773 | B1 * | 8/2009 | West | E21B 23/04 137/268 |
| 7,845,413 | B2 | 12/2010 | Shampine et al. | |
| 7,976,259 | B2 * | 7/2011 | Craig | B01J 8/002 198/660 |
| 8,127,844 | B2 | 3/2012 | Luharuka et al. | |
| 8,136,585 | B2 * | 3/2012 | Cherewyk | E21B 33/068 137/268 |
| 8,905,133 | B2 | 12/2014 | Potapenko et al. | |
| 9,133,701 | B2 | 9/2015 | Luharuka et al. | |
| 2003/0116314 | A1 * | 6/2003 | Dallas | E21B 17/1007 166/249 |
| 2003/0221838 | A1 * | 12/2003 | Dallas | E21B 17/1007 166/373 |
| 2005/0184083 | A1 * | 8/2005 | Diaz | E21B 33/138 221/75 |
| 2005/0217868 | A1 * | 10/2005 | Dallas | E21B 33/068 166/387 |
| 2006/0289166 | A1 | 12/2006 | Stromquist et al. | |
| 2007/0125544 | A1 | 6/2007 | Robinson et al. | |
| 2007/0197851 | A1 | 8/2007 | Rogers et al. | |
| 2008/0257449 | A1 * | 10/2008 | Weinstein | B01F 13/0035 141/67 |
| 2009/0095481 | A1 * | 4/2009 | Pich | B02C 18/08 166/304 |
| 2010/0147866 | A1 * | 6/2010 | Witkowski | E21B 33/068 221/1 |
| 2010/0243255 | A1 | 9/2010 | Luharuka et al. | |
| 2013/0105166 | A1 | 5/2013 | Medvedev et al. | |
| 2014/0000899 | A1 | 1/2014 | Nevison | |
| 2015/0021011 | A1 | 1/2015 | Bihun et al. | |
| 2015/0096739 | A1 | 4/2015 | Ghasripoor et al. | |
| 2015/0184492 | A1 | 7/2015 | Ghasripoor et al. | |
| 2015/0292297 | A1 | 10/2015 | Kajaria et al. | |
| 2015/0292310 | A1 | 10/2015 | Ghasripoor et al. | |
| 2016/0084044 | A1 | 3/2016 | Shen et al. | |
| 2016/0108713 | A1 | 4/2016 | Dunaeva et al. | |
| 2016/0122628 | A1 * | 5/2016 | Babcock | C09K 8/80 166/305.1 |
| 2018/0363422 | A1 * | 12/2018 | Roberts, IV | E21B 47/00 |
| 2019/0218899 | A1 | 7/2019 | Keilers et al. | |

OTHER PUBLICATIONS

PCT Partial International Search/Invitation to Pay Fees; Application No. PCT/US2017/065470; dated Mar. 21, 2018; 13 pages.

International Preliminary Report on Patentability issued in PCT Application PCT/US2017/065470, dated Jun. 20, 2019 (11 pages).

International Search Report issued in International Patent Appl. No. PCT/US2017/050386 dated Dec. 4, 2017; 4 pages.

Written Opinion issued in International Patent Appl. No. PCT/US2017/050386 dated Dec. 4, 2017; 11 pages.

Office Action issued in Russian Patent Application No. 2019109979 dated Dec. 16, 2020; 19 pages (with English translation).

Decision on Grant issued in Russian Patent Application No. 2019109979 dated Mar. 24, 2021; 18 pages (with English translation).

International Preliminary Report on Patentability issued in International Patent Appl. No. PCT/US2017/050386 dated Mar. 21, 2019, 13 pages.

* cited by examiner

APPARATUS AND METHOD OF DISBURSING MATERIALS INTO A WELLBORE

This application claims priority to and benefit from U.S. Provisional Application No. 62/432,301, filed Dec. 9, 2016, entitled "Apparatus and Method of Disbursing Materials into a Wellbore," the contents of which is incorporated by reference in its entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

This disclosure relates generally to systems and methods for delivering an oilfield material (e.g., a slurry mixture, a diverting fluid, a fracturing fluid, a proppant, a proppant additive) to a well at a wellsite. Production of oil and gas from subterranean formations presents a myriad of challenges. One such challenge is the lack of permeability in certain formations. Often oil or gas-bearing formations, that may contain large quantities of oil or gas, do not produce at a desirable production rate due to low permeability. The low permeability may cause a poor flow rate of the sought-after hydrocarbons. To increase the flow rate, a stimulation treatment can be performed. One such stimulation treatment is hydraulic fracturing.

Hydraulic fracturing is a process whereby a subterranean hydrocarbon reservoir is stimulated to increase the permeability of the formation, thereby increasing the flow of hydrocarbons from the reservoir. Hydraulic fracturing includes pumping a fracturing fluid at a high pressure (e.g., in excess of 10,000 psi) to crack the formation and create larger passageways for hydrocarbon flow. The fracturing fluid may have proppants added thereto, such as sand or other solids that fill the cracks in the formation, so that, at the conclusion of the fracturing treatment, when the high pressure is released, the cracks remain propped open, thereby permitting the increased hydrocarbon flow possible through the produced cracks to continue into the wellbore.

To displace the fracturing fluid into the well, large wellsite operations generally employ a variety of positive displacement or other fluid delivering, large scale pumps. However, some fracturing fluids contain particles with diameters that may not easily pass through certain fracturing equipment (e.g., pumps). In some instances, these larger diameter particles contribute to premature wear and degradation of the fracturing equipment. In other instances, these large diameter particles may not be able to pass through fracturing equipment because clearances in the equipment are smaller than the particles. Moreover, maintaining and operating large-scale equipment capable of supplying the oil material having the large diameter particles may be cost prohibitive and less efficient to operate.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
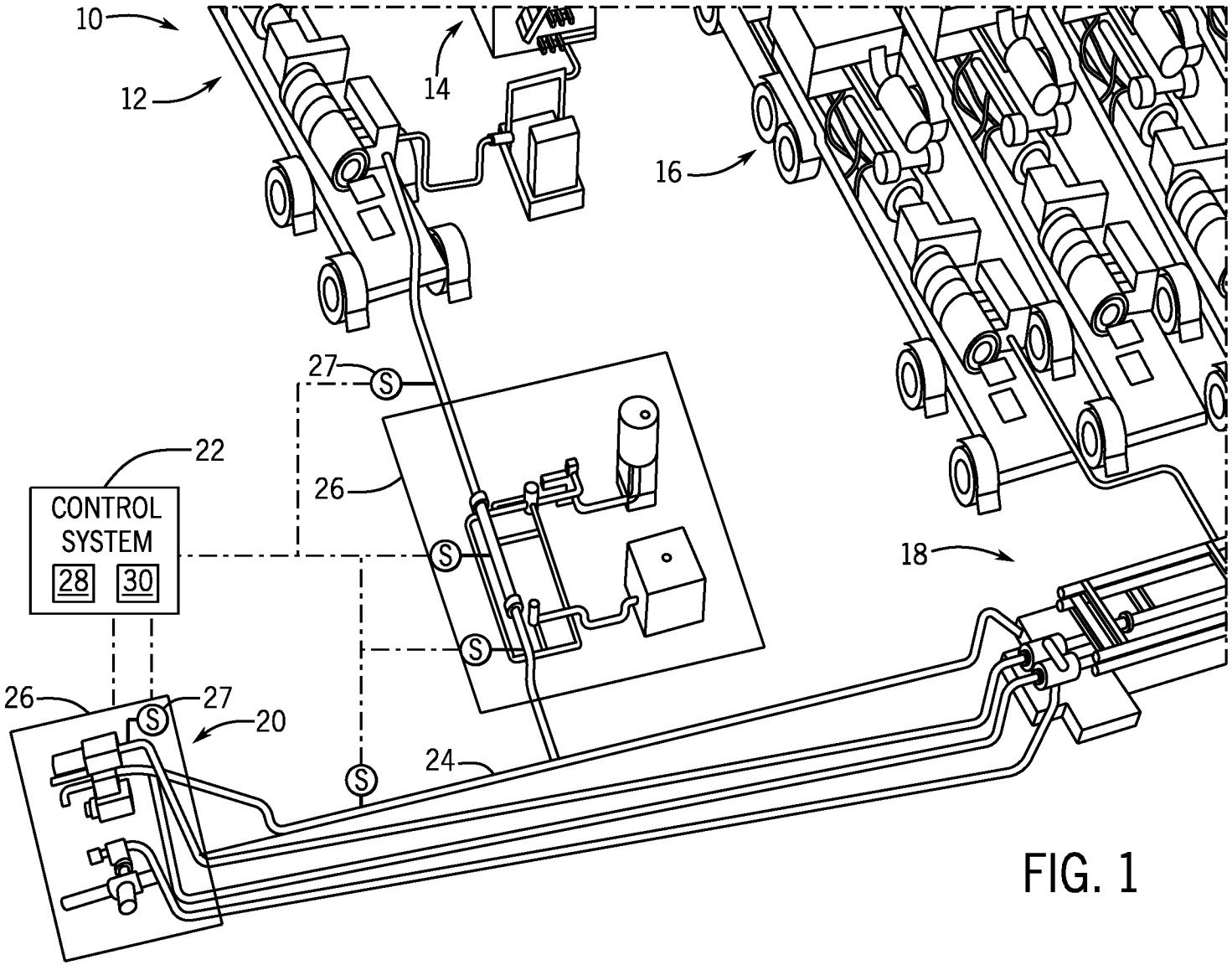
FIG. 1 is a schematic diagram of a wellsite that may be used to introduce oilfield materials to a wellbore, in accordance with an embodiment.

One or more specific embodiments of the present disclosure will be described below. These described embodiments are only exemplary of the various systems and methods described herein. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The following definitions are provided in order to aid those skilled in the art in understanding the detailed description. The term "treatment", or "treating", refers to any subterranean operation that uses a fluid in conjunction with a desired function and/or for a desired purpose. The term "treatment" or "treating" does not imply any particular action by the fluid. The term "fracturing" refers to the process and methods of breaking down a geological formation and creating a fracture, i.e. the rock formation around a well bore, by pumping fluid at very high pressures (pressure above the determined closure pressure of the formation), in order to increase production rates from a hydrocarbon reservoir. The particular fracturing methods may include any suitable technologies.

The present disclosure relates to systems and methods for introducing an oilfield material, such as a slurry mixture, a diverting fluid, a fracturing fluid, proppant, or proppant additive, to a high-pressure side of a hydraulic well simulation system. The slurry mixture, diverting fluid, fracturing fluid, proppant, or proppant additive may contain larger particles (e.g., with a diameter size of greater than 5 mm), which may be injected into a dispensing device that is located between a missile trailer and a wellhead (e.g., a high-pressure injector line), or directly at the wellhead. The dispensing device holds the oilfield material in the device until it is displaced into a main treatment line or the wellbore, depending on where the dispensing device is disposed. For example, the dispensing device may be coupled to a frac-tree at the wellhead to provide the materials directly to the wellbore. Alternatively, the dispensing device may be disposed upstream of the wellhead.

The wellsite system enables remote operation of the dispensing device, thereby enabling multi-stage hydraulic fracturing operations. The dispensing device may utilize flow control elements (e.g., valves, pumps, etc.) and a control system to enable the dispensing device to dispense oilfield materials throughout the duration of a fracturing treatment. In one embodiment, the larger particle slurries may be provided to the dispensing device via a plurality of valves disposed along the dispensing device. The valves may be actuated to fill the dispensing device, store the oilfield materials in the dispensing device, and/or dispense the oilfield materials from the dispensing device. A control system may remotely control the dispensing device through several continuous multistage fracturing treatments. It may be appreciated that the disclosed embodiments of the dispensing device may be controlled remotely or at the wellsite 10. The dispensing device and the control system may be further understood with reference to FIGS. 1-12, as discussed above.

By way of introduction, FIG. 1 is a high-level schematic diagram of a wellsite system 10 that may be used to provide oilfield materials into a high-pressure fluid flow used in the stimulation of subsurface formations through a wellbore, in accordance with an embodiment. The wellsite system 10 may include various pieces of equipment to complete the stimulation of the subsurface formation, such as hydraulic fracturing equipment. The above-ground hydraulic fracturing equipment may include a fracturing pump 12, a hydration unit 14, a battery of pump unit trailers 16, a manifold (e.g., missile) trailer 18 coupled to the battery of pump unit trailers 16, a wellhead 20, and one or more control systems 22. The above-ground hydraulic fracturing equipment may also include one or more treating lines 24 (e.g., a main line). The treating lines 24 may be used to provide a pressurized slurry mixture into the wellhead 20 for use in the hydraulic fracturing operation.

The treating lines 24 may be fluidly coupled to a dispensing device 26. The dispensing device 26 may be controlled by the control system 22. The dispensing device 26 may be used to dispense the oilfield material with a larger particle size (e.g., diameter size of greater than 5 mm), such as a slurry mixture, a diverting fluid, a fracturing fluid, proppant, or proppant additive, to the treating line 24 or to the wellhead 20. The dispensing device 26 may include a high-pressure inlet that is fluidly coupled to the pump unit trailers 16. The dispensing device 26 may also include a pressure outlet that is fluidly coupled to the treating line 24 and/or the wellhead 20. As described above, the dispensing device 26 may be disposed at a location between the manifold (e.g., missile) trailer 18 and/or the battery of pump unit trailers 16 and the wellhead 20.

The control system 22 includes a memory 28 and a processor 30. The memory 28 may store program instructions that are loadable and executable on the processor(s) 30, as well as data generated during the execution of these programs. Depending on the configuration and type of the control system 22, the memory 28 may be volatile (such as random access memory (RAM)) and/or non-volatile (such as read-only memory (ROM), flash memory, etc.). The computing device or server may also include additional removable storage and/or non-removable storage including, but not limited to, magnetic storage, optical disks, and/or tape storage. The disk drives and their associated computer-readable media may provide non-volatile storage of computer-readable instructions, data structures, program modules, and other data for the computing devices. In some implementations, the memory 28 may include multiple different types of memory, such as static random access memory (SRAM), dynamic random access memory (DRAM), or ROM.

To control the actuation of the flow control elements, the control system 22 may receive signals from one or more sensors 27 disposed throughout the wellsite system 10. For example, the wellsite system 10 may include sensors 27 that measure a line pressure (e.g., treating line pressure, injector line pressure), flow sensors (e.g., to measure flow rate of the slurry mixture), displacement sensors (e.g., to sense a valve position), level sensors (e.g., to measure a storage tank level), concentration sensors (e.g., to measure a proppant concentration of the slurry mixture), or other suitable sensors. It may be appreciated that one or more of the sensors 27 may function as transducer (e.g., to receive a signal and retransmit in a different form). Other sensors 27 may output data indicative of operating conditions throughout the wellsite 10. The sensors 27 may output data to the control system 22 to adjust operation of the various embodiments of the dispensing devices 26, as explained in further detail below with reference to FIGS. 2-12.

Figure 2:
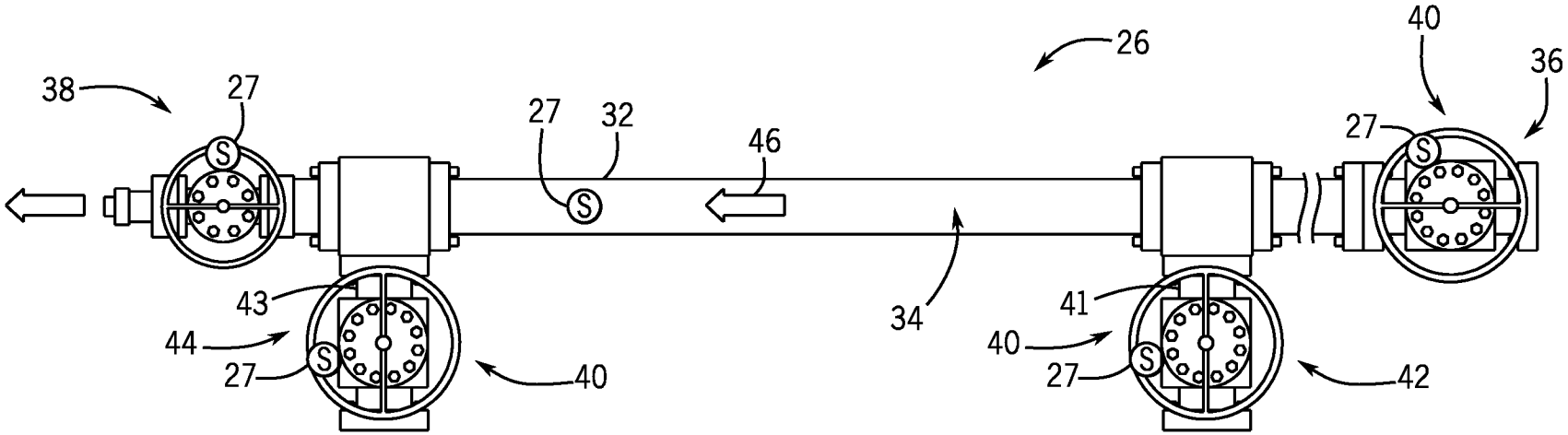
FIG. 2 is a schematic diagram of another embodiment of a dispensing device including a material chamber for dispensing oilfield materials to the wellbore using a plurality of gate valves, in accordance with an embodiment.

FIG. 2 is a schematic diagram of an embodiment of the dispensing device 26 including a material chamber 32 for dispersing oilfield materials to the wellbore. The size (e.g., volume) of the material chamber 32 is determined based on a volume and to have a suitable pressure rating. The material chamber 32 may receive a slurry mixture 34 through a material chamber fill line 41 via an inlet valve 42. The slurry mixture 34 may include large particles (e.g., particles with a diameter of greater than 5 mm) to be pumped into the main treating line 24 and/or the wellhead 20 through an outlet 38, as described in detail below. The amount of slurry mixture 34 that may be pumped into the material chamber 32 may range from approximately 1 gallon to over 20 gallons of fluid. In some embodiments, the material chamber 32 may use a material chamber overflow line 43 to adjust (e.g., reduce, remove) the amount of oilfield materials from the material chamber 32 via an outlet valve 44. For example, if the sensor 27 measures a concentration of proppant or a flowrate of the oilfield material is too high, the control system 22 may actuate (e.g., open) the outlet valve 44 to selectively reduce the flow of the oilfield materials through the material chamber 32.

After the material chamber 32 is filled with the oilfield materials, the oilfield materials are moved through the material chamber 32 via introducing a high-pressure fluid (e.g., a sand/water mixture to the material chamber 32). The material chamber 32 includes an inlet 36 (e.g., a high pressure inlet from a pump truck) and an outlet 38 (e.g., a high pressure outlet to the main treating line 24). The material chamber 32 uses one or more isolation devices (e.g., valves 40, gate valves) to fill the material chamber 32 with a high pressure fluid (e.g., a sand/water mixture) from the high pressure inlet 36 to move the oilfield materials from the inlet 36 to the outlet 38 of the material chamber 32.

The valves 40 may be manually operated or remotely controlled via the control system 22. For example, the control system 22 may receive one or more signals from the position sensors 27, which are communicatively coupled to the valves 40. For example, the control system 22 may control actuation of the valves 40 to control the rate at which the oilfield materials (e.g., the slurry mixture 34) are introduced to the material chamber 32. In some embodiments, the rate at which the oilfield materials are introduced to the material chamber 32 may vary based at least in part on a stage of fracturing operations (e.g., a first stage of a multi-stage fracturing operation).

The control system 22 may be used to control the amount of oilfield materials that fill the material chamber 32. For example, the control system 22 may fill the material chamber 32 to a desired volume through the material chamber fill line 41 by opening the inlet valve 42 (e.g., a gate valve). The control system 22 may control the flow rate at which the material chamber 32 is filled by controlling the level, which the inlet valve 42 is opened. Once the desired volume of the oilfield material has filled the material chamber 32, the control system 22 may close the inlet valve 42. The control system 22 may then receive an indication (e.g., a signal) that a desired process condition (e.g., a pressure reading associated with the material chamber 32, concentration of the proppant, etc.) is met. The control system 22 may also open a relief valve to enable the pressure in the material chamber 32 to vent to the atmosphere. The control system 22 may then open the isolation devices (e.g., valves 40) associated with the inlet 36 and the outlet 38 to enable the high-pressure fluid (e.g., a sand/water mixture) to be pumped into the material chamber 32. As described above, the oilfield material may be pumped into the main lines 24 and/or into the wellbore at the wellhead 20.

Figure 3:
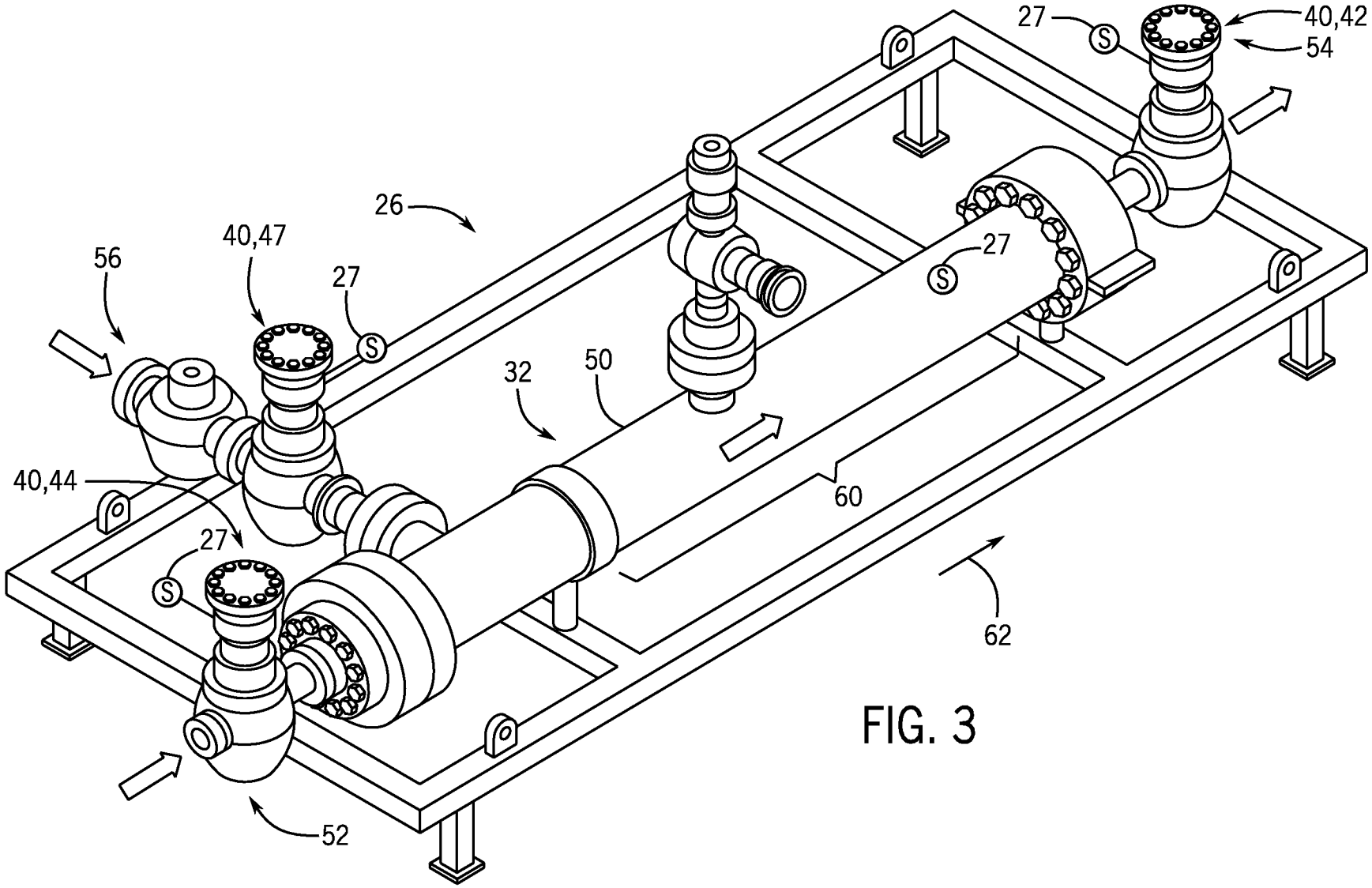
FIG. 3 is a schematic diagram of another embodiment of the dispensing device including a material chamber for dispensing oilfield materials to the wellbore using a plurality of plug valves, in accordance with an embodiment.

FIG. 3 is a schematic diagram of another embodiment of a dispensing device 26 including a material chamber 32 (e.g., a fill line 50) for dispensing oilfield materials to the wellbore using a plurality of plug valves, in accordance with an embodiment. The amount of slurry mixture 34 that may be dispensed into the fill line 50 may range from approximately 1 gallon to over 20 gallons of fluid. The material chamber 32 may receive the slurry mixture 34 through a material chamber fill line 56 through an inlet valve 47 (e.g., a gate valve). For example, the one or more sensors 27 associated with the inlet valve 47 or the material chamber fill line 56 may output data related to the position of the inlet valve 47 or the flowrate of the oilfield material (e.g., slurry mixture 34) through the material chamber fill line 56. The control system 22 may control the position of the inlet valve 47 to adjust (e.g., increase, reduce) the amount of oilfield materials (e.g., slurry mixture 34) introduced to the material chamber 32. After the material chamber 32 is filled with the oilfield materials, the oilfield materials are moved through the material chamber via a high-pressure fluid (e.g., a sand/water mixture). The material chamber 32 includes an inlet 52 (e.g., a high pressure inlet from a pump truck) and an outlet 54 (e.g., a high pressure outlet to a main treating line). The material chamber 32 uses one or more isolation devices (e.g., valves 40, plug valves) to fill the material chamber 32 with the high-pressure fluid (e.g., a sand/water mixture) from the high-pressure inlet 52 to move the oilfield materials from the inlet 52 to the outlet 54 of the material chamber 32 (e.g., the fill line 50). The material chamber 32 (e.g., the fill line 50) uses one or more valves 40 (e.g., plug valves) and/or a spool iron to fill and/or deploy the oilfield materials from the material chamber 32 (e.g., the fill line 50) as explained in further detail below.

The valves 40 may be manually operated or remotely controlled via the control system 22. As described above, the control system 22 may receive one or more signals from the position sensors 27 which are communicatively coupled to the valves 40. The oilfield materials (e.g., the slurry mixture 34) may be stored in a middle portion 60 of the fill line 50 until the oilfield materials are ready to be provided to the wellbore. For example, when both a forward valve 42 (e.g., plug valve) and a rear valve 44 (e.g., plug valve) are open, the oilfield materials may be directed from the fill line 50 in a direction (as indicated by arrows 62) to the wellhead 20. It may be appreciated that the valves 40 (e.g., the forward valve 42, the rear valve 44) may be remotely or manually controlled to flush and/or clean the fill line 50.

As described with reference to FIG. 2, the control system 22 may be used to control the amount of oilfield materials that fill the material chamber 32 (e.g., the fill line 50). The control system 22 may fill the material chamber 32 to a desired volume through the material chamber fill line 56 by opening the inlet valve 47 (e.g., a plug valve). It may be appreciated that the plug valve may be used in applications where the flow rate of the oilfield materials introduced to the material chamber 32 (e.g., the fill line 50) may not require as precise flow control as compared to the embodiment of the material chamber 32, which uses gate valves, such as the embodiment depicted in FIG. 2. For example, applications using the gate valves may be beneficial in circumstances where it is helpful to fill the material chamber 32 more rapidly. The control system 22 may control the flow rate at which the material chamber 32 (e.g., the fill line 50) is filled by controlling the level, which the inlet valve 47 is opened.

Once the desired volume of the oilfield material (e.g., slurry mixture 34) has filled the material chamber 32, the control system 22 may close the inlet valve 47. The control system 22 may then receive an indication (e.g., a signal) that a desired process condition (e.g., a pressure reading associated with the material chamber 32, concentration of the proppant, etc.) is met. The control system 22 may also open a relief valve to enable the pressure in the material chamber 32 to vent to the atmosphere. The control system 22 may then open the isolation devices (e.g., valves 40) associated with the inlet 52 and the outlet 54 to enable the high-pressure fluid (e.g., a sand/water mixture) to be pumped into the material chamber 32. As described above, the oilfield material may be pumped into the main lines 24 and/or into the wellbore at the wellhead 20.

Figure 4:
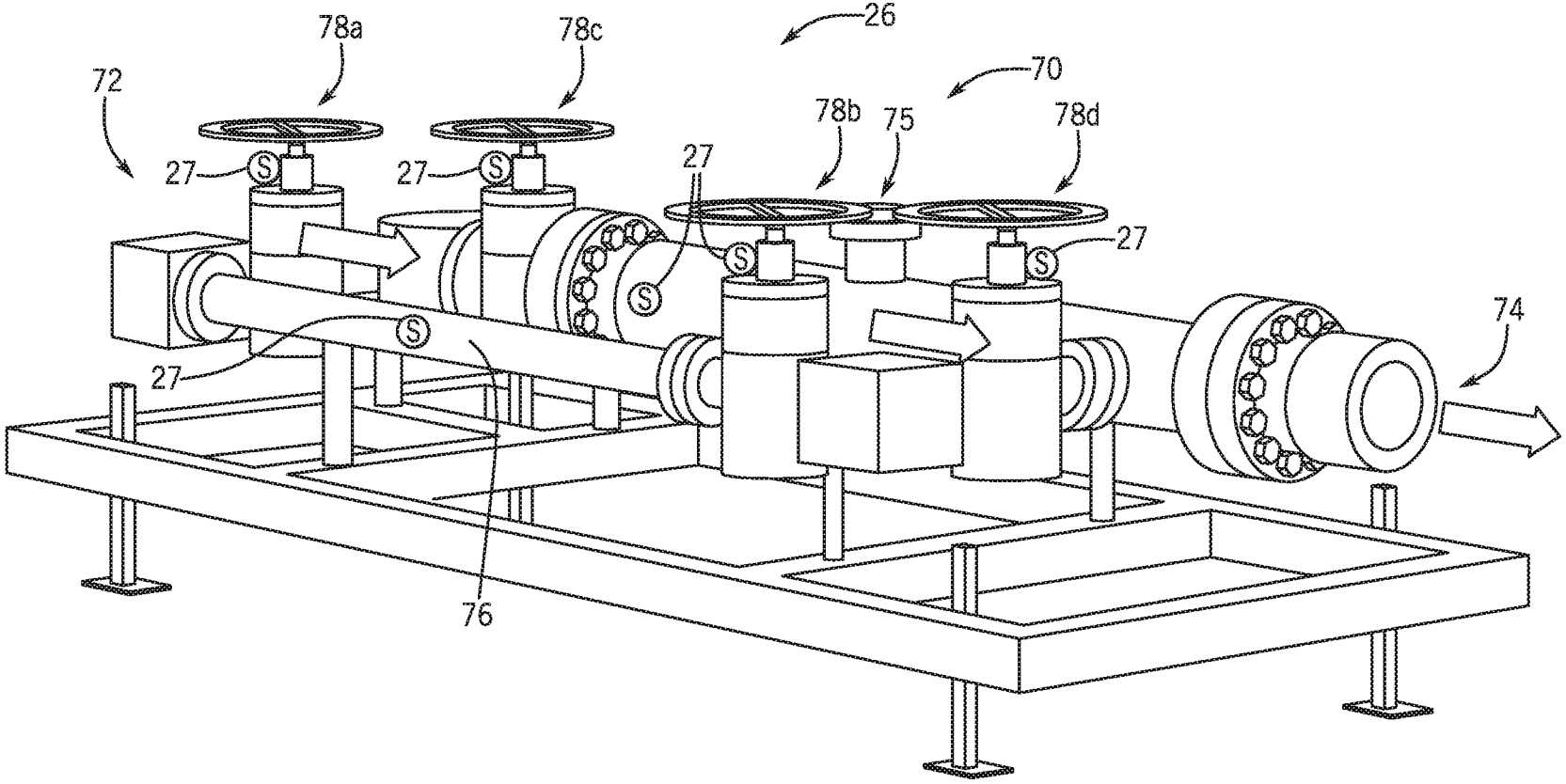
FIG. 4 is a schematic diagram of another embodiment of the dispensing device including a modified debris catcher with a material chamber for dispensing oilfield materials to the wellbore, in accordance with an embodiment.

FIG. 4 is a schematic diagram of an embodiment of a dispensing device 26 including a modified debris catcher with a material chamber 32 for dispensing oilfield materials to the wellbore in accordance with an embodiment. In the illustrated embodiment, the material chamber 32 may utilize various assets (e.g., a debris catcher 70) to store the oilfield materials (e.g., the slurry mixture 34). As explained in detail below, the debris catcher 70 may be modified to create the material chamber 32 that is fluidly coupled to one or more material fill lines 76 to receive the oilfield materials). That is, components (e.g., a screen) associated with the debris catcher 70 may be removed to create the material chamber 32. As may be appreciated, the debris catcher 70 may be modified by personnel on-site to create an embodiment of the material chamber 32 to utilize assets, generate an embodiment of the material chamber 32 relatively quickly, or replace another embodiment of the material chamber 32 (e.g., during a turnaround or maintenance).

The one or more material fill lines 76 may include an inlet 72 to receive the oilfield materials (e.g., the slurry mixture 34). The material chamber 32 receives the oilfield materials (e.g., the slurry mixture 34) from the one or more material fill lines 76, which are fluidly coupled to the material chamber 32 and store the oilfield materials until they are released to the material chamber 32. The flow of oilfield materials (e.g., the slurry mixture 34) to the material chamber 32 may be controlled via one or more isolation devices (e.g., one or more gate valves 78).

The gate valves 78 associated with the material fill line (e.g., 78*a*, 78*b*) may control the flow of the oilfield materials (e.g., the slurry mixture 34) from the material fill line 76 to the material chamber 32. As described above with reference to FIGS. 2 and 3, the control system 22 may control actuation of the valves 78*a*, 78*b* to control the rate at which the oilfield materials (e.g., the slurry mixture 34) are introduced to the material chamber 32. The control system 22 may use one or more signals from the sensors 27 disposed along the material chamber 32 and/or associated with the valves 78 to control the flow of the oilfield materials from the material fill line 76 to the material chamber 32. The gate valves 78 may be manually operated or remotely controlled via the control system 22.

The material chamber 32 also includes an inlet 73 (e.g., a high pressure inlet from a pump truck) and an outlet 74 (e.g., a high-pressure outlet to the main treating line 24). After the material chamber 32 is filled with the oilfield materials, the oilfield materials are moved through the material chamber 32 via the high-pressure fluid (e.g., a sand/water mixture). The flow of the high-pressure fluid may be controlled via actuation of the valves 78*c*, 78*d* that are associated with the material chamber 32. The material chamber 32 may use a material chamber overflow line 75 that is fluidly coupled to the material chamber 32. In some embodiments, the material chamber overflow line 75 may reduce the amount of high pressure fluid in the material chamber 32, to reduce the concentration of proppant in the slurry mixture 34, and so forth.

The control system 22 may fill the material chamber fill line 76 to a desired volume through the material chamber fill line 76 by opening the inlet valve 78*a*, 78*b* (e.g., gate valves). The control system 22 may control the flow rate at which the material chamber fill line 76 is filled by controlling the level which the valves 78*a*, 78*b* are opened. Once the desired volume of the oilfield material (e.g., slurry mixture 34) has filled the material chamber fill line 76, the control system 22 may close the gate valves 78*a*, 78*b*. The control system 22 may then receive an indication (e.g., a signal) that a desired process condition (e.g., a pressure reading associated with the material chamber fill line 76, concentration of the proppant, etc.) is met. The control system 22 may then open the isolation devices (e.g., valves 78*c*, 78*d*) associated with the inlet 73 and the outlet 74 and the material chamber 32 to enable the high pressure fluid (e.g., a sand/water mixture) to be pumped into the material chamber 32. As described above, the oilfield material may be pumped into the main lines 24 and/or into the wellbore at the wellhead 20.

Figure 5:
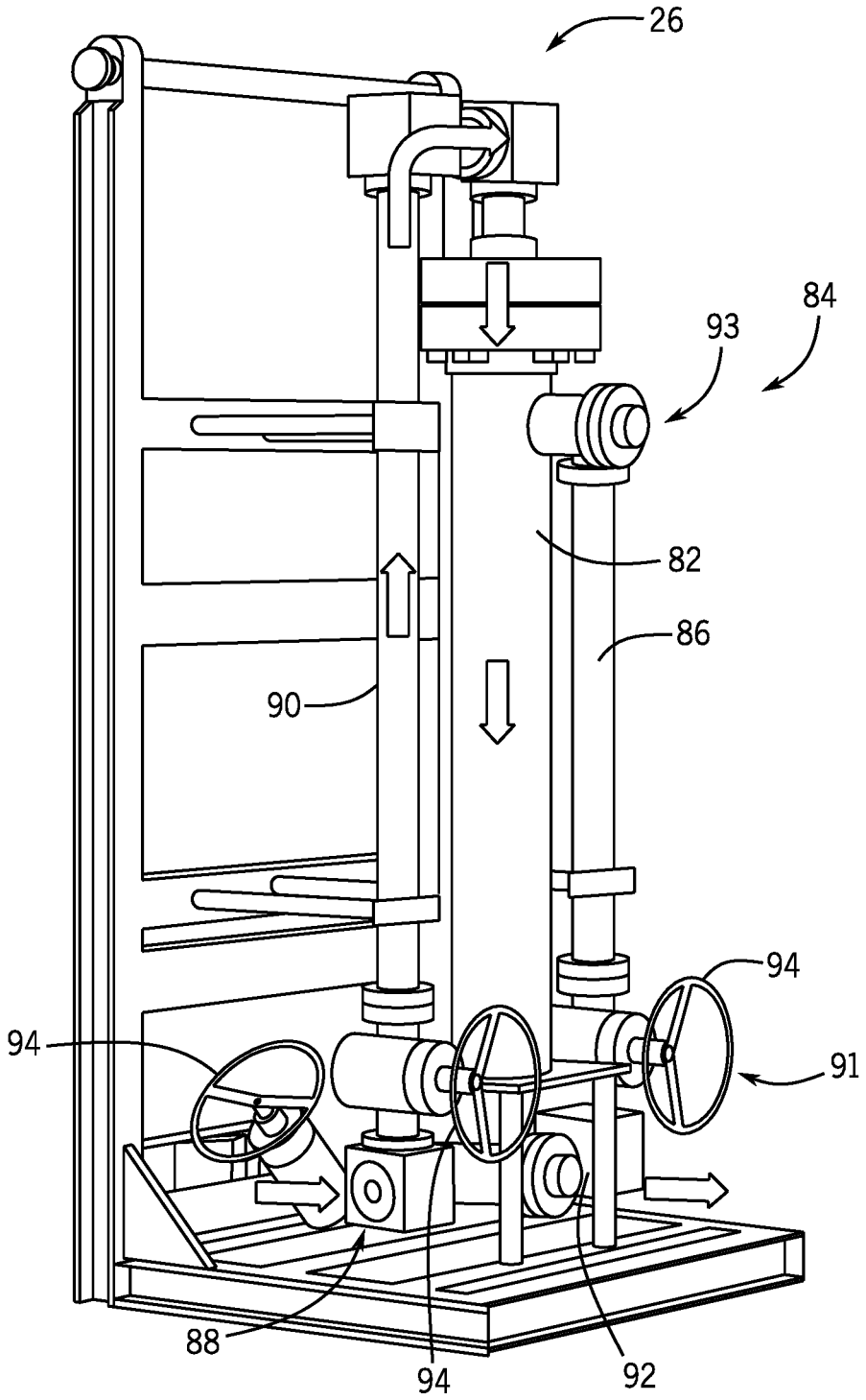
FIG. 5 is a schematic diagram of another embodiment of the dispensing device including a sand separator with a vertical material chamber for dispensing oilfield materials to the wellbore, in accordance with an embodiment.

FIG. 5 is a schematic diagram of an embodiment of a dispensing device 26 including a sand separator with a vertical material chamber 82 for dispensing oilfield materials to the wellbore in accordance with an embodiment. The size (e.g., volume) of the vertical material chamber 82 may be determined based on a volume and to have a suitable pressure rating. In the illustrated embodiment, the dispensing device 26 may utilize various assets such as a sand separator 84. It may be appreciated that utilizing the vertical material chamber 82 may reduce the overall footprint of the wellsite by reducing an amount of space occupied by the vertical material chamber 82 in the wellsite 10, as compared to a horizontally disposed material chamber. The sand separator 84 may store the oilfield materials in the vertical material chamber 82 until the oilfield materials are dispensed into the main treating line 24 and/or into the wellbore at the wellhead 20, as described in detail below.

The amount of the slurry mixture 34 that may be pumped into the vertical material chamber 82 may range from approximately 1 gallon to over 20 gallons of fluid. The oilfield materials may be loaded into the vertical material chamber 82 via a material chamber fill line 86. The oilfield materials (e.g., the slurry mixture 34) may be pumped into the material chamber fill line 86. The material chamber fill line 86 may include an inlet 91 and a material chamber overflow line 93. As may be appreciated, the material chamber overflow line 93 may be used to adjust the amount of oilfield materials that are filled into the material chamber line 86. The flow of the oilfield materials (e.g., the slurry mixture 34) may be controlled via one or more gate valves 94 associated with the material chamber fill line 86.

After the material fill chamber 86 is filled with the oilfield materials (e.g., the slurry mixture 34), the control system 22 may close the valve 94 associated with the material fill chamber 86 and the vertical material chamber 82 is filled with the oilfield materials. It may be appreciated that the vertical material chamber 82 may be filled in part via gravitational forces, air, and/or a liquid. The vertical material chamber 82 includes a high-pressure inlet 88 to fluidly couple to a pump unit trailer 16 and a high-pressure outlet 92 that is fluidly coupled to the main line 24 and/or at the wellhead 20.

The control system 22 may control actuation of the valves 94 to control the rate at which the oilfield materials (e.g., the slurry mixture 34) are introduced to the vertical material chamber 82 and/or the material fill chamber 86. For example, the control system 22 may open the valve 94 associated with the high-pressure inlet 88 and the high-pressure outlet 92 to introduce the high-pressure fluid material (e.g., the sand/water mixture) into the vertical chamber 82. Introducing the high-pressure fluid may push the oilfield materials through the vertical material chamber 82 along a flow path 90. The oilfield materials are then pumped from the vertical material chamber 82 through the high-pressure outlet 92. The high-pressure outlet 92 may be fluidly coupled to the main line 24 or to a location at the wellhead 20 to flow the oilfield materials into the wellbore.

As may be appreciated, the control system 22 may fill the vertical material chamber 82 to a desired volume through the material fill chamber 86. The control system 22 may control the flow rate at which the vertical material chamber 82 is filled by controlling the level, which the gate valve 94 is opened. Once the desired volume of the oilfield material (e.g., slurry mixture 34) has filled the vertical material chamber 82, the control system 22 may close the gate valve 94 associated with the vertical material chamber 82. The control system 22 may then receive an indication (e.g., a signal) that a desired process condition (e.g., a pressure reading associated with the material chamber 32, concentration of the proppant, etc.) is met. The control system 22 may then open the isolation devices (e.g., valves 94) associated with the inlet 88 and the outlet 92 to enable the high pressure fluid (e.g., a sand/water mixture) to be pumped into the material chamber 32 to push the oilfield materials along the flow path 90.

Figure 6:
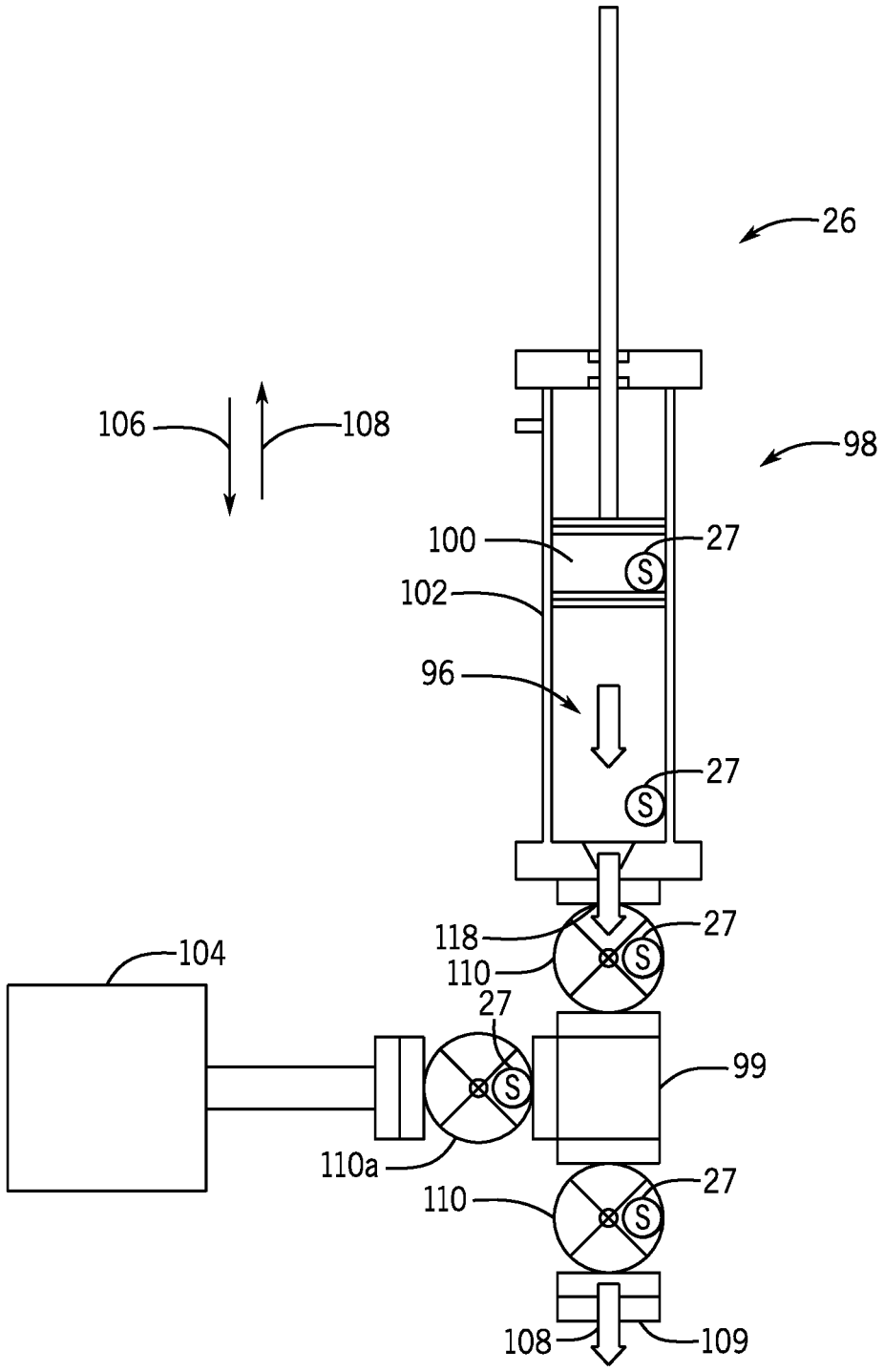
FIG. 6 is a schematic diagram of another embodiment of the dispensing device including a material chamber and piston assembly for dispensing oilfield materials to the wellbore, in accordance with an embodiment.

FIG. 6 is a schematic diagram of an embodiment of a dispensing device 26 including a material chamber 96 and piston assembly 98 for dispensing oilfield materials to the wellbore in accordance with an embodiment. The piston assembly 98 may be oriented in a horizontal or a vertical direction. It may be appreciated that the piston assembly 98 may be used with other embodiments of the dispensing device 26, such as a screw mechanism described with respect to FIGS. 11-12. The piston assembly 98 includes a piston rod 100 contained within a cylinder 102 to form the material chamber 96. It may be appreciated that the oilfield materials (e.g., the slurry mixture 34) may be stored in a hopper or storage tank 104 until they are drawn into the piston assembly 98. The piston assembly 98 may include an inlet 99 to receive the oilfield materials. The oilfield materials may be isolated via one or more isolation devices (e.g., control valves 110) associated with the piston assembly 98, including the inlet 99, as explained in further detail below. The material chamber 96 may be filled with approximately 1 gallon to over 20 gallons of the oilfield materials (e.g., the slurry mixture 34). The amount of the oilfield materials that are introduced to the material chamber 96 may be controlled with increased precision when certain materials (e.g., incompressible fluids) are used.

The piston rod 100 may be moved in a first direction 106 to introduce (e.g., via suction) the oilfield materials to the material chamber 96 from the storage tank 104. It may be appreciated that moving the piston rod 100 in a second direction 108 opposite the first direction may push the oilfield materials out of the material chamber 96 via an outlet 109 that is fluidly coupled to the main line 24 and/or at a location near the wellhead 20. The distance the piston rod 100 is moved in the direction 108 may be determined in part by a position sensor 27 that is coupled to the piston rod 100. The sensors 27 may also be used to measure the amount of oilfield materials, which are introduced to the material chamber 96.

The piston assembly 98 may be manually operated or remotely controlled via the control system 22. The control system 22 may control actuation of the valves 110 and/or components of the piston assembly 98. The control system 22. The control system 22 may control the flow rate at which the material chamber 96 is filled by controlling the level which the valves 110 associated with the piston assembly 98, including the inlet 99, are opened. Once the desired volume of the oilfield material (e.g., slurry mixture 34) has filled the material chamber 96, the control system 22 may close one or more of the valves 110 associated with the inlet 99 to stop the flow of the oilfield materials into the material chamber 96. The control system 22 may then receive an indication (e.g., a signal) that a desired process condition (e.g., a volume reading associated with the material chamber 96, concentration of the proppant, etc.) is met. The control system 22 may then actuate the piston rod 100 within the cylinder 102 in the direction 108 to push the oilfield materials from the material chamber 96 to the main flow line 24 or to the wellbore via a location at the wellhead 20.

Figure 7:
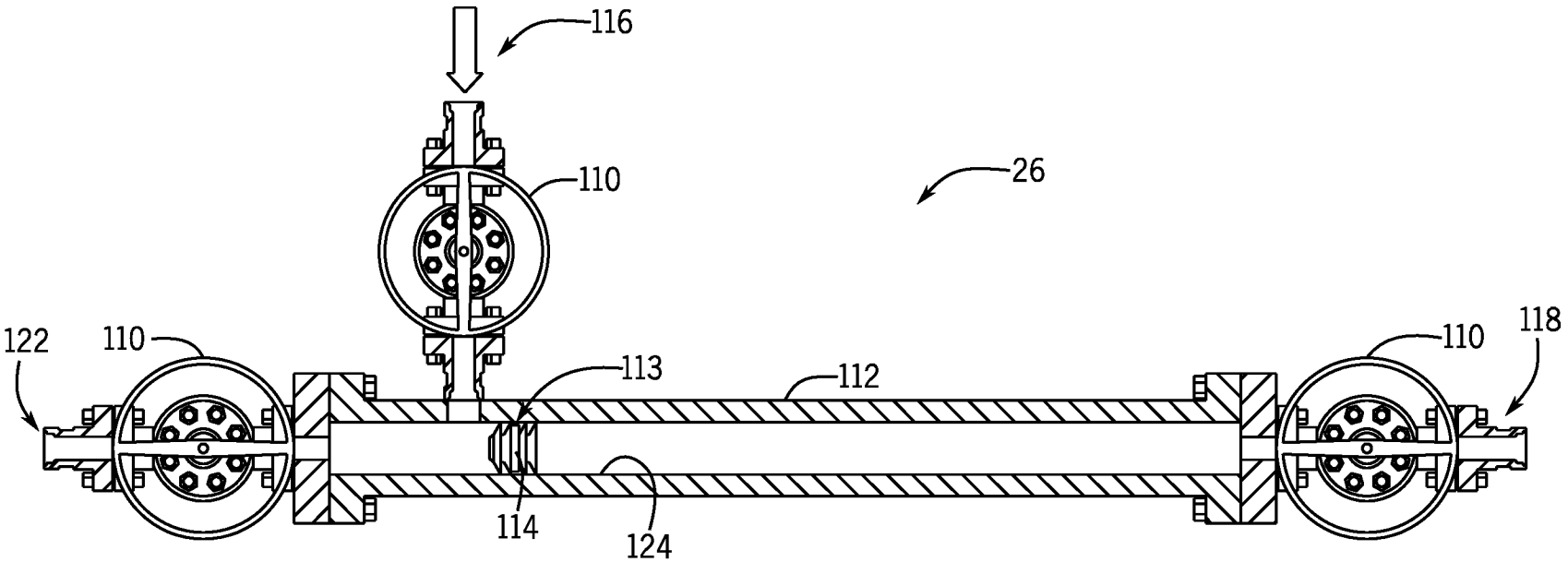
FIG. 7 is a schematic diagram of another embodiment of the dispensing device including a material chamber and a dart disposed in an initial position for dispensing oilfield materials to the wellbore, in accordance with an embodiment.
Figure 8:
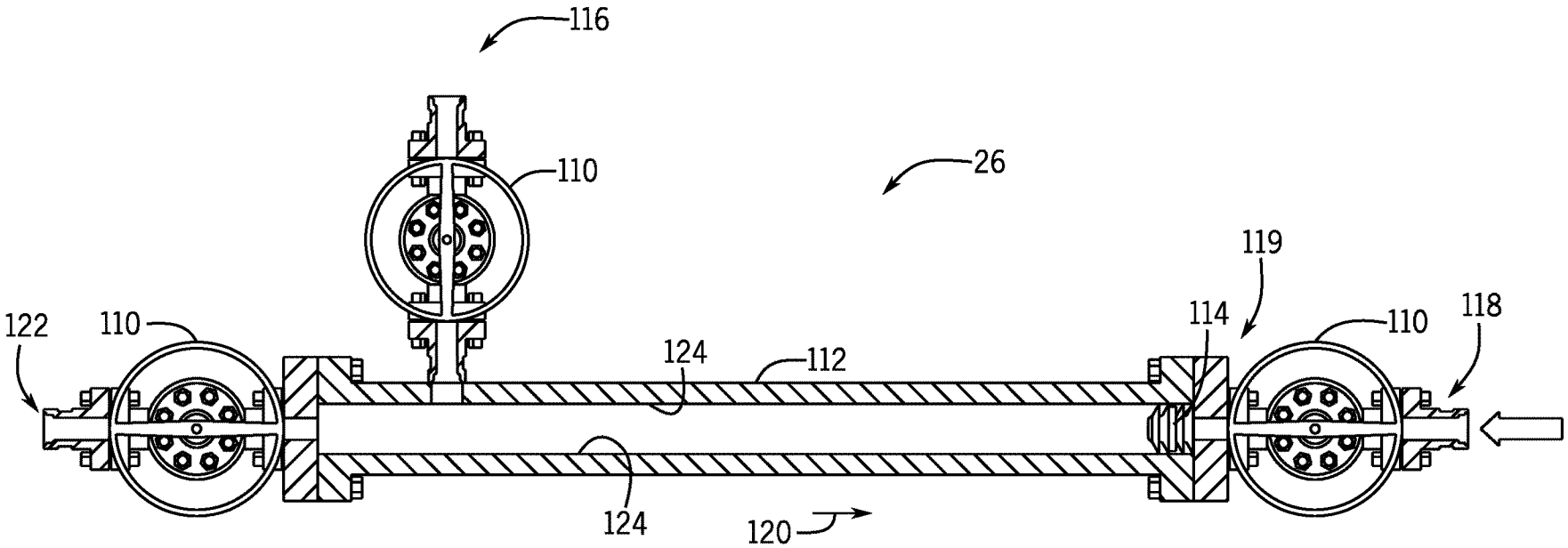
FIG. 8 is a schematic diagram of another embodiment of the dispensing device including a material chamber and the dart disposed in an secondary position for dispensing oilfield materials to the wellbore, in accordance with an embodiment.
Figure 9:
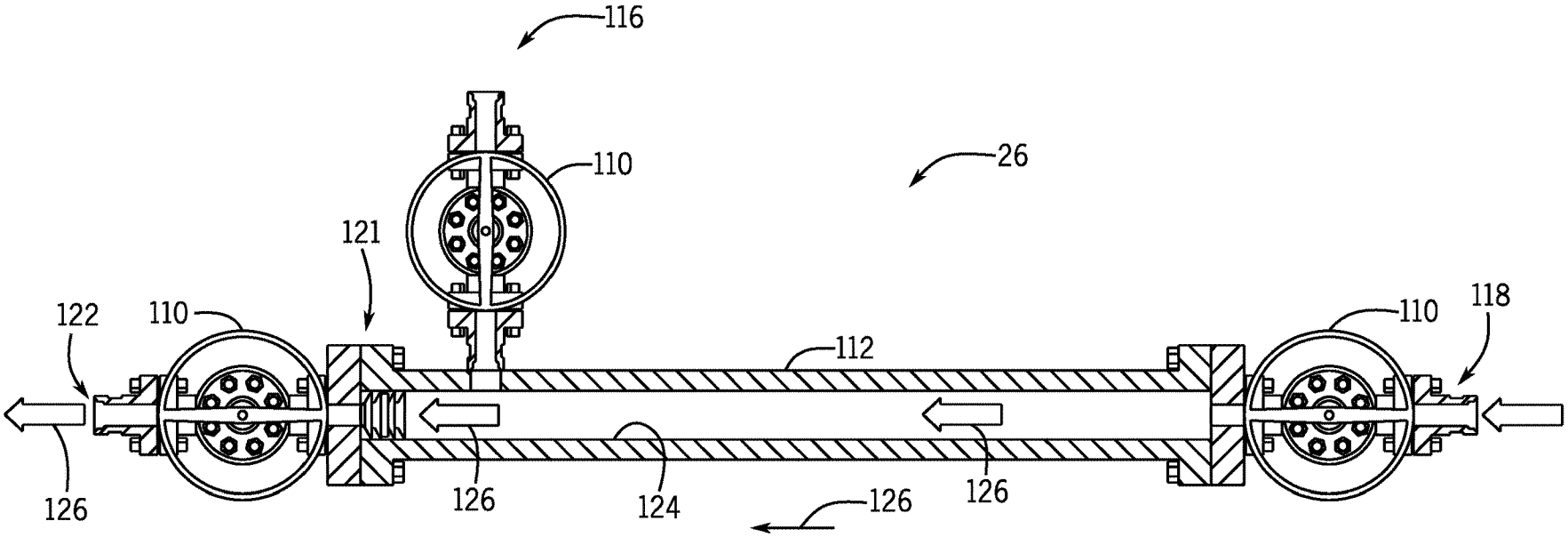
FIG. 9 is a schematic diagram of another embodiment of the dispensing device including a material chamber and a dart disposed in a tertiary position for dispensing oilfield materials to the wellbore, in accordance with an embodiment.

FIGS. 7-9 illustrate an example sequence associated with an embodiment of the dispensing device 26, where the dispensing device 26 includes a dart 114 disposed within a material chamber 112. It may be appreciated that the material chamber 112 and the dart 114 may be oriented in a horizontal or a vertical direction. The material chamber 112 and the dart 114 may used with other embodiments of the dispensing device 26, such as the screw mechanism described with respect to FIG. 10. FIG. 7 is a schematic diagram of an embodiment of a dispensing device 26 where the dart 114 is disposed in an initial position 113 within the material chamber 112. The oilfield materials are introduced to the material chamber 112 via a fill line 116. As may be appreciated, the fill line 116 may use the valve 110 to fill the oilfield materials into the material chamber 112. Before the oilfield materials are introduced to the material chamber 112, the dart 114 is located in a first position 113 near the fill line 116. As the oilfield materials are introduced by opening the valve 110 associated with the fill line 116, the dart 114 moves in a direction 120 toward a high-pressure inlet 118 of the material chamber 112, as illustrated in FIG. 8.

FIG. 8 is a schematic diagram of an embodiment of a dispensing device 26 where the dart 114 is disposed in a secondary position within the material chamber 112. As described above, the oilfield materials are introduced to the material chamber 112 via the fill line 116. As the oilfield materials are introduced to the material chamber 112 through the valve 110, the dart 114 is moved in the direction 120 towards a secondary position 119 near the high-pressure inlet 118. As may be appreciated, the high-pressure inlet 118 may be fluidly coupled to the pump unit trailers 16. When the high-pressure inlet 118 receives the high-pressure fluid (e.g., sand/water mixture), the dart 114 may be pushed in a direction 126 opposite the direction 120, as illustrated in FIG. 9.

FIG. 9 is a schematic diagram of an embodiment of a dispensing device 26 where the dart 114 is disposed in a tertiary position 121 within the material chamber 112. As the dart 114 is pushed by the high-pressure fluid, the oilfield materials are pumped out of the material chamber 112 through the high-pressure outlet 122 associated with the material chamber 112. The high-pressure outlet 122 may be fluidly coupled to the main line 24 or at a location near the wellhead 20. As may be appreciated, the dart 114 may provide an added benefit of wiping an inner surface 124 of the material chamber 112 clean. Still further, it may be appreciated that the embodiments disclosed herein may utilize more than one dart 114 within the material chamber 112.

The control system 22 may control the valves 110 associated with the material chamber 113 and/or the actuation of the dart 114 within the material chamber 112. The control system 22 may fill the material chamber 112 to a desired volume through the fill line 116 by opening the valve 110 associated with the fill line 116. The control system 22 may control the flow rate and/or the volume of the material to the material chamber 112. As the material chamber 112 fills with the oilfield materials, the control system 22 may control the movement of the dart 114. The control system 22 may move the dart towards the inlet 118 of the material chamber 112. Once the control system 22 receives an indication (e.g., a signal) that a desired process condition (e.g., a pressure reading associated with the material chamber 112) is met, then the control system 22 may open the valve 110 associated with the inlet 118 to enable the flow of the high pressure fluid (e.g., the sand/water mixture) into the material chamber 112. The control system 22 may also open the valve 110 associated with the outlet 122 to enable the flow of the oilfield materials out of the material chamber 112. As described above, the control system 22 may control the actuation of the dart 114 to move the dart along the material chamber 112 towards the outlet 122. The oilfield materials may be pumped into the main lines 24 and/or into the wellbore at the wellhead 20.

Figure 10:
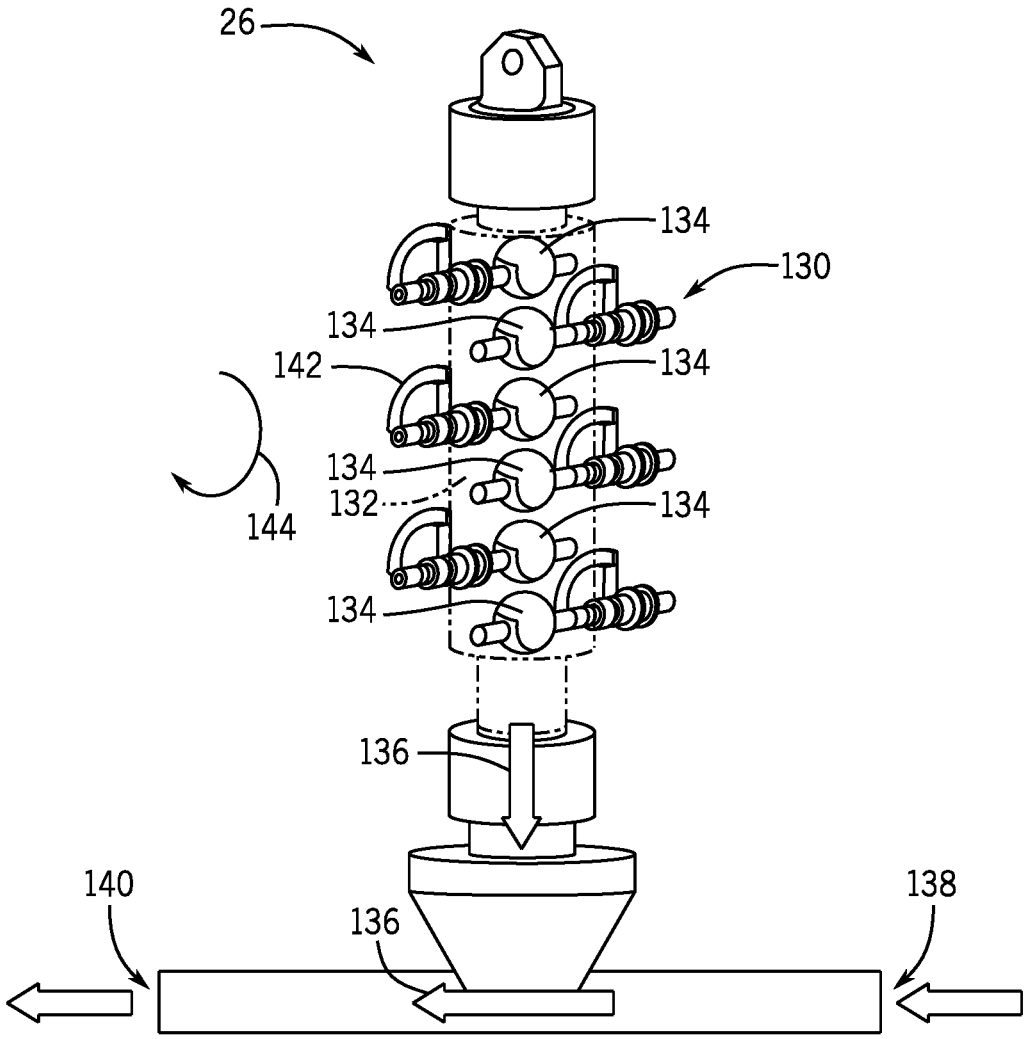
FIG. 10 is a schematic diagram of another embodiment of the dispensing device including a ball launcher for dispensing oilfield materials to the wellbore, in accordance with an embodiment.

FIG. 10 is a schematic diagram of an embodiment of a dispensing device 26 including a ball launcher 130 for dispensing oilfield materials to the wellbore in accordance with an embodiment. The ball launcher 130 may be disposed upstream from the wellbore 20 along the main line 24, or the ball launcher 130 may be coupled to a frac-tree. The ball launcher 130 includes a material chamber 132, which includes a plurality of oilfield material containing balls 134. The balls 134 travel in along a flow path indicated by arrows 136 and exit through a ball launcher outlet 127. The ball launcher outlet 127 is fluidly coupled to the main line 24 or the frac-tree, as described above.

The balls 134 may be made of a soluble material (e.g., polyvinyl alcohol, etc.) to store the oilfield materials. The soluble material of the balls 134 may be dissolved when the balls 134 are released into the flow path indicated by arrows 136. The balls 134 may be retained in the ball launcher until the balls 134 are released via a trigger (e.g., a time-delay trigger, a desired concentration, etc.). The soluble materials the balls 134 are made of may dissolve when the balls 134 come into contact with the high-pressure fluid (e.g., sand/water), thereby releasing the oilfield materials to the main line 24 and/or the wellbore. That is, the high-pressure fluid introduced via a high pressure inlet 138 may flow towards a high-pressure outlet 140 to dissolve an outer coating of the balls 134, which are made from the soluble materials so that the oilfield materials (e.g., the slurry mixture 34) can be released into the wellbore.

When the trigger is activated, the control system 22 may release one or more of the balls 134 from the ball launcher 130 to the outlet 127. The control system 22 may receive an indication (e.g., a signal) that the trigger is activated. The control system 22 may determine the number of balls 134 to be released, the desired concentration of oilfield materials (e.g., slurry mixture 34) to be met, an amount of time to release the balls 134, and so forth. The control system 22 may then release the balls 134 from the ball launcher 130 by actuating one or more cams 142 associated with the balls 134 in a direction 144 towards the outlet 127. The control system 22 then deploys the balls 134 along the flow path indicated by the arrows 136. The control system 22 may monitor one or more process conditions (e.g., the amount of time the balls 134 are deployed, the amount of soluble materials released from the balls 134, etc.) until the desired condition is met, at which point the control system 22 may stop the deployment of the balls 134 from the ball launcher 130. The control system 22 may monitor the process conditions until more oilfield materials are to be released into the main line 24 and/or the wellbore.

Figure 11:
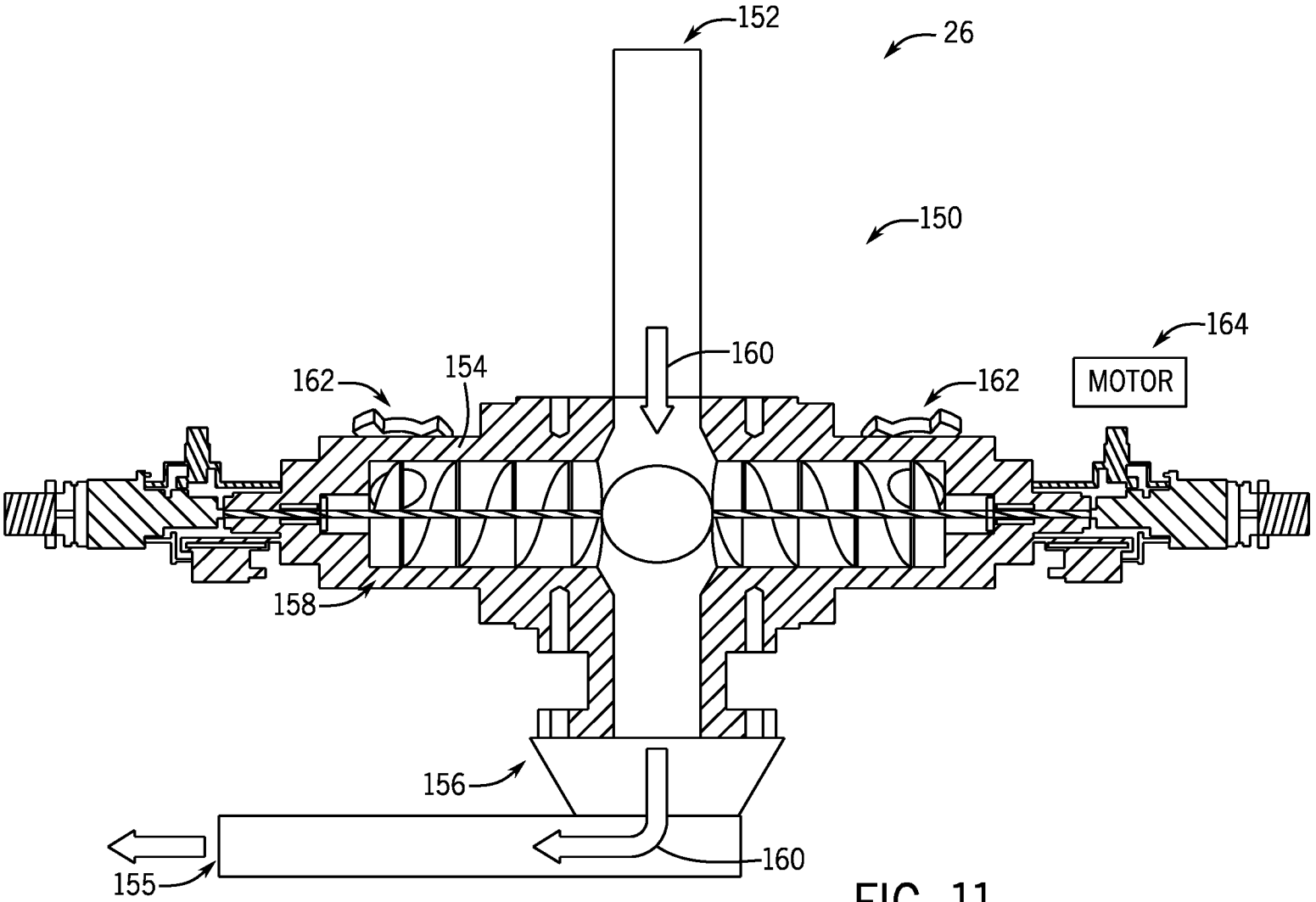
FIG. 11 is a schematic diagram of another embodiment of the dispensing device including a screw mechanism for dispensing oilfield materials to the wellbore, in accordance with an embodiment.

FIG. 11 is a schematic diagram of an embodiment of a dispensing device 26 including a screw mechanism 150 for dispensing oilfield materials to the wellbore in accordance with an embodiment. The screw drive mechanism 150 may be fluidly coupled to the main treatment line 24 or closer to the wellbore at the wellhead 20, as described in detail below. The screw mechanism 150 includes a high-pressure inlet 152, which fluidly couples to a pump unit 16. The pump unit 16 may inject high-pressure fluid material into a material chamber 158. The high-pressure fluid (e.g., sand/water mixture) may push the oilfield materials through the material chamber 158 along a flow path indicated by arrow 160. The oilfield materials are provided from the material chamber 158 through a high-pressure outlet 155. The high-pressure outlet 155 is fluidly coupled to the main line 24.

The screw mechanism 150 includes a plurality of threads 154 and a base unit 156. The screw mechanism 150 may include one or more material loading inlets 162. The material inlets 162 may receive oilfield materials, which can be stored in a material chamber 158 until they are driven from the material chamber 158 via an electric motor 164. The electric motor 164 moves the threads 154 through the material chamber 158 to push the oilfield materials through the material chamber 158.

The control system 22 may control the flow of the oilfield materials (e.g., the flow rate of the oilfield materials, the amount of the oilfield materials) through the material inlets 162 and/or the operation of the screw mechanism 150. The control system 22 may open the material loading inlets 162 to fill the material chamber 158 with the oilfield materials. The control system 22 may receive an indication (e.g., a signal) that a trigger to release the oilfield materials is activated. The control system 22 may determine the amount of the oilfield materials to be released, such as by determining the desired concentration of oilfield materials (e.g., slurry mixture 34) to be met or an amount of time to release the oilfield materials. The control system 22 may then activate the motor 164 to drive the threads 154 of the screw mechanism 150. The oilfield materials are then moved from the material chamber 158 and come into contact with the high-pressure fluid (e.g., sand/water mixture). The control system 22 then deploys the materials along the flow path indicated by the arrows 160. The control system 22 may monitor one or more process conditions (e.g., the amount of soluble materials released from the material chamber 158, etc.) until the desired condition is met, at which point the control system 22 may stop the motor 164 so that the oilfield materials are suspended in the material chamber 158. The control system 22 may monitor the process conditions until more of the oilfield materials are to be released into the main line 24 and/or the wellbore and begin operating the screw mechanism 150 again.

In some embodiments, the dispensing device 26 may include a plurality of the screw mechanisms 150 disposed around a central borehole allowing various oilfield materials (e.g., proppant, diversion material, fibers, etc.) to be driven into the wellbore. The various screw mechanisms 150 may introduce different amounts of the oilfield materials to create a desired composition to be dispersed into the wellbore. In other words, the dispensing device 26 (e.g., the screw mechanism 150) enables the oilfield materials to be blended directly at the wellhead 20 or the main line 24. It may be appreciated that the screw mechanisms 150 may be disposed upstream from the wellbore along the main line or be coupled to a frac-tree, as described further with reference to FIG. 12.

Figure 12:
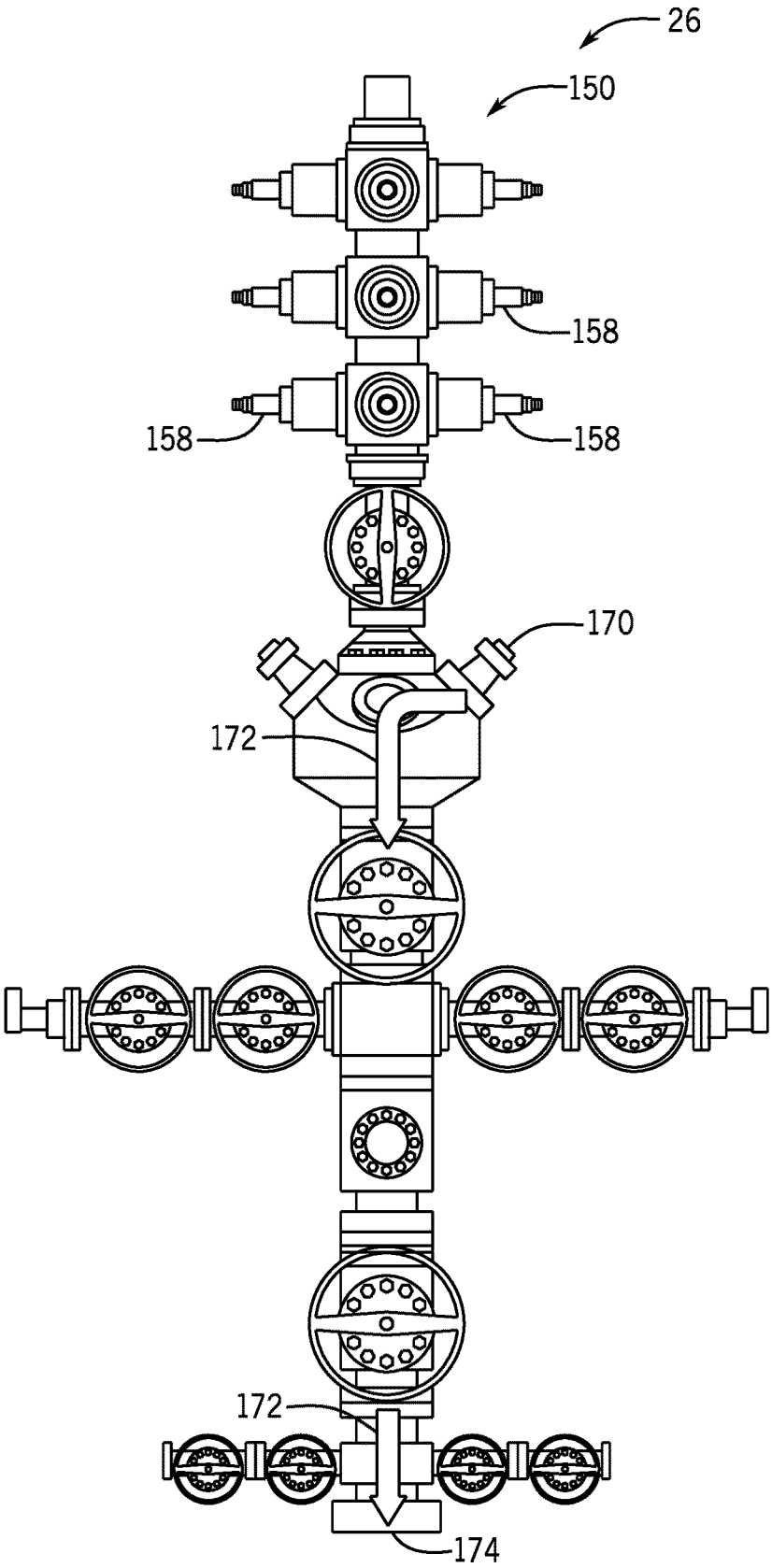
FIG. 12 is a schematic diagram of another embodiment of the dispensing device including a screw mechanism coupled to a frac-tree for dispensing oilfield materials to the wellbore, in accordance with an embodiment.

FIG. 12 is a schematic diagram of an embodiment of a dispensing device 26 including the screw mechanism 150 coupled to a frac-tree for dispensing oilfield materials to the wellbore in accordance with an embodiment. In the illustrated embodiment, the screw mechanism 150 may be attached directly onto the frac-tree at the wellhead 20. As described above, the screw mechanism 150 includes one or more material chambers 158 to disperse the oilfield materials. In the illustrated embodiment, the screw mechanism 150 may be isolated from a high-pressure inlet 170 via a valve 168, as described in detail below.

The screw mechanism 150 includes the high-pressure inlet 170 to receive high-pressure fluid material (e.g., sand/water mixture), which may push the oilfield materials from the inlet 170 along a flow path indicated by arrow 172 to an outlet 174. The outlet 174 may be directly coupled to the wellhead 20 to flow the oilfield materials into the wellbore.

As described above with reference to FIG. 11, the screw mechanism 150 includes a plurality of threads 154 and one or more material loading inlets 162. The material inlets 162 may receive oilfield materials, which can be stored in the material chambers 158 until they are driven from the material chamber 158 via the electric motors 164. The electric motor 164 moves the threads 154 through the material chambers 158 to push the different oilfield materials (e.g., proppant, diversion material, fibers) through the material chambers 158 to create a desired composition to be driven into the wellbore. In other words, the dispensing device 26 (e.g., the screw mechanism 150) enables the oilfield materials (e.g., proppant, diversion material, fibers) to be blended directly at the wellhead 20 or the main line 24.

The control system 22 may control the flow of the oilfield materials (e.g., the composition of the oilfield materials that are blended together, the flow rate of the oilfield materials, the amount of the oilfield materials) through the material inlets 162 and/or the operation of the screw mechanism 150. The control system 22 may open the material loading inlets 162 to fill the material chamber 158 with the oilfield materials. The control system 22 may receive an indication (e.g., a signal) that a trigger to release the oilfield materials is activated. The control system 22 may determine the amount of the oilfield materials to be released, such as by determining the desired composition of oilfield materials (e.g., slurry mixture 34). The control system 22 may then activate the motor 164 to drive the threads 154 of the screw mechanism 150. Each of the oilfield materials are then dispensed from their respective material chambers 158 to form the oilfield materials of the desired composition. The oilfield materials then come into contact with the high-pressure fluid (e.g., sand/water mixture). The control system 22 then deploys the materials along the flow path indicated by the arrows 174. The control system 22 may monitor one or more process conditions (e.g., the amount of soluble materials released from the material chamber 158, etc.) until the desired condition is met, at which point the control system 22 may stop the motor 164 so that the oilfield materials are suspended in the material chamber 158. The control system 22 may monitor the process conditions until more of the oilfield materials are to be released into the main line 24 and/or the wellbore and begin operating the screw mechanism 150 again.

Figure 13:
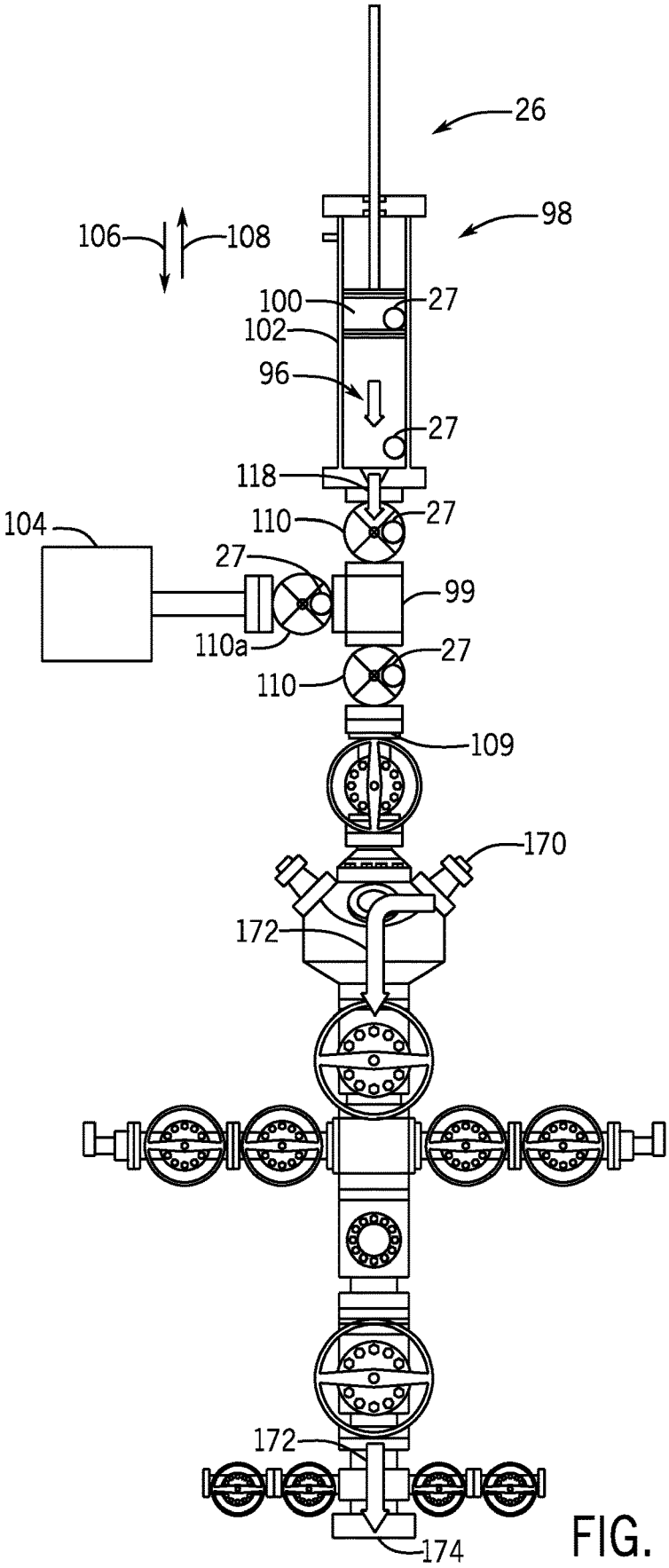
FIG. 13 is a schematic diagram of another embodiment of the dispensing device including the piston assembly of FIG. 6 coupled to the frac-tree for dispensing oilfield materials to the wellbore, in accordance with an embodiment.

FIG. 13 is a schematic diagram of another embodiment of the dispensing device including the piston assembly 98 of FIG. 6 coupled to the frac-tree for dispensing oilfield materials to the wellbore 20, in accordance with an embodiment. In the illustrated embodiment, the piston assembly 98 may be coupled to or attached directly onto the frac-tree at the wellhead 20.

At the outlet 109 of the piston assembly 98, the high-pressure inlet 170 receives the oilfield materials dispensed from the piston assembly 98. The high-pressure inlet 170 introduces high-pressure fluid material through the inlet and along the 172 flow path to the outlet 174. As described above, the outlet 174 may be directly coupled to the wellhead 20 to introduce the oilfield materials into the wellbore.

As may be appreciated, the control system 22 may be used to control the volume of the oilfield materials introduced to the piston assembly 98, as described above with reference to FIG. 6. After the desired volume of the oilfield materials is ready to be dispensed from the piston assembly 98, the oilfield materials may be released from the material chamber 96. The control system 22 may receive an indication that a trigger to release the oilfield materials from the piston assembly 98 is activated. The oilfield materials may then come into contact with the high-pressure fluid (e.g., sand/water mixture). The oilfield materials are then deployed along the flow path indicated by arrows 174.

Figure 14:
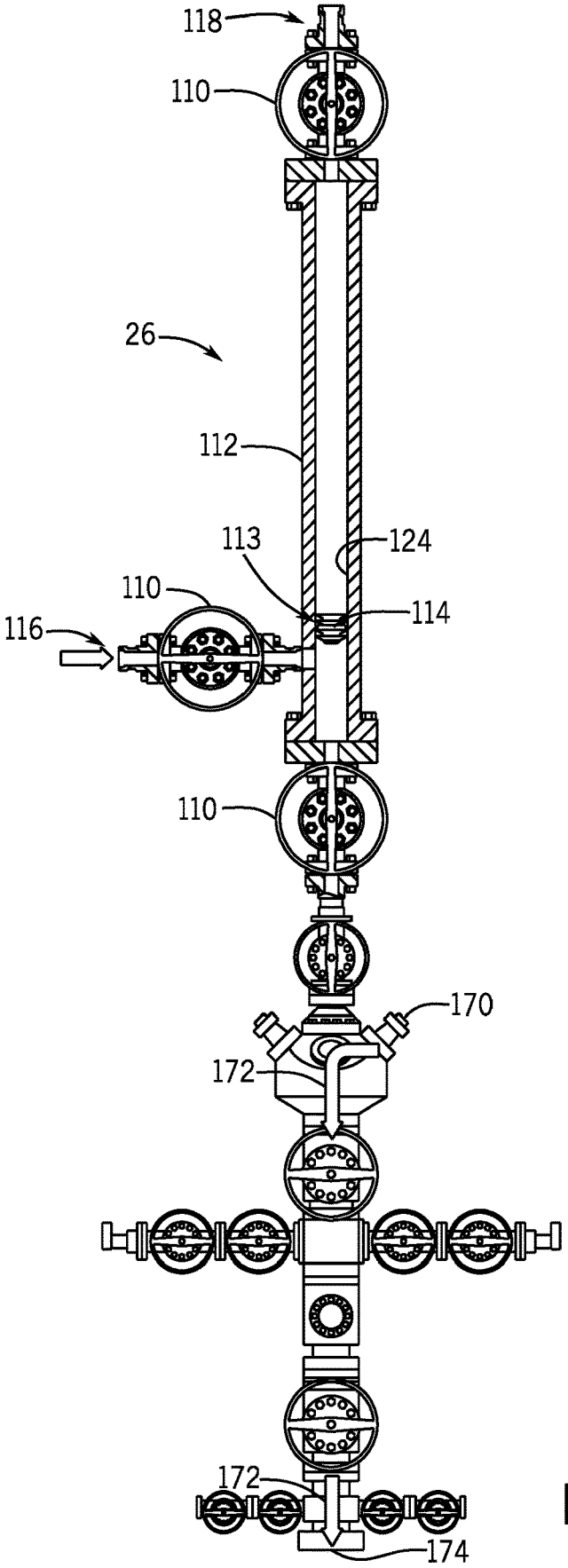
FIG. 14 is a schematic diagram of another embodiment of the dispensing device including the dart assembly of FIGS. 7-9 coupled to the frac-tree for dispensing oilfield materials to the wellbore, in accordance with an embodiment.

FIG. 14 is a schematic diagram of another embodiment of the dispensing device including the material chamber 112 and the dart 114 of FIGS. 7-9 coupled to the frac-tree for dispensing oilfield materials to the wellbore 20, in accordance with an embodiment. In the illustrated embodiment, the material chamber 112, including the dart 114, may be coupled to or attached directly onto the frac-tree at the wellhead 20.

At the outlet 122 of the dispensing device 26 (e.g., the material chamber 112 and the dart 114), the high-pressure inlet 170 receives the oilfield materials dispensed from the material chamber 112. The high-pressure inlet 170 introduces high-pressure fluid material through the inlet and along the 172 flow path to the outlet 174. As described above, the outlet 174 may be directly coupled to the wellhead 20 to introduce the oilfield materials into the wellbore.

As may be appreciated, the control system 22 may be used to control the actuation of the dart 114 thereby controlling the volume of the oilfield materials introduced to the material chamber 112, as described above with reference to FIGS. 7-9. After the desired volume of the oilfield materials is ready to be dispensed from the material chamber 112, the oilfield materials may be released. The control system 22 may receive an indication that a trigger to release the oilfield materials from the material chamber 112 is activated. The oilfield materials may then come into contact with the high-pressure fluid (e.g., sand/water mixture). The oilfield materials are then deployed along the flow path indicated by arrows 174.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a screw mechanism comprising:

a chamber configured to receive a pressurized fluid via a first inlet fluidly coupled to a pumping unit;

a second inlet disposed on a first side of the first inlet and a third inlet disposed on a second side of the first inlet, wherein the second inlet and the third inlet are configured to directly receive a first oilfield material comprising a first fluid in a fluid state via a first fluid flow and a second oilfield material comprising a second fluid in the fluid state via a second fluid flow, respectively, wherein the first fluid is different from the second fluid, and wherein the first side is located on an opposite side of the first inlet with respect to the second side;

a plurality of threads configured to:

directly receive the first fluid via the second inlet and the second fluid via the third inlet; and direct the first fluid and the second fluid into the chamber by pushing the fluid into the chamber;

an electric motor configured to control a motion of the plurality of threads;

a plurality of sensors configured to measure one or more properties related to the screw mechanism and an amount of soluble material output by the chamber; and a control system communicatively coupled to the screw mechanism, wherein the control system is configured to:

open the second inlet and the third inlet to provide the plurality of threads with the first fluid and the second fluid, respectively; and actuate the plurality of threads via the electric motor to push the first fluid received via the second inlet and the second fluid received via the third inlet into the chamber to combine with the pressurized fluid, and wherein a combination of the pressurized fluid and the pressurized fluid received via the first inlet, the first fluid received via the second inlet, and the second fluid received via the third inlet is dispensed from the chamber through a single outlet to a wellhead, wherein the single outlet is configured to directly couple to the chamber.

2. The system of claim 1, comprising a second screw mechanism configured to push a third oilfield material different than the first oilfield material and the second oilfield material, wherein the third oilfield material comprises a third fluid in the fluid state via a third fluid flow into the chamber.

3. The system of claim 2, wherein the screw mechanism and the second screw mechanism are configured to push a desired amount of the first oilfield material and the second oilfield material and the third oilfield material into the chamber to combine with the pressurized fluid, thereby creating a fourth oilfield material having a desired composition.

4. The system of claim 1, wherein the control system is configured to:

monitor the one or more properties to determine whether the combination of the pressurized fluid, the first oilfield material, and the second oilfield material includes a threshold concentration of the first oilfield material or the second oilfield material; and stop the electric motor in response to the combination of the pressurized fluid, the first oilfield material, and the second oilfield material including the threshold concentration of the first oilfield material or the second oilfield material.

5. The system of claim 1, wherein the first inlet, the second inlet, and the third inlet are aligned along an axis of the chamber.

* * * * *